US007726740B2

(12) United States Patent
Masunaga

(10) Patent No.: US 7,726,740 B2
(45) Date of Patent: Jun. 1, 2010

(54) BACKREST-TILTING DEVICE

(75) Inventor: Hiroshi Masunaga, Yokohama (JP)

(73) Assignee: Okamura Corporation (JP)

( * ) Notice: Subject to any disclaimer, the term of this patent is extended or adjusted under 35 U.S.C. 154(b) by 340 days.

(21) Appl. No.: 11/575,737

(22) PCT Filed: Sep. 21, 2005

(86) PCT No.: PCT/JP2005/017354

§ 371 (c)(1),
(2), (4) Date: Aug. 15, 2007

(87) PCT Pub. No.: WO2006/033339

PCT Pub. Date: Mar. 30, 2006

(65) Prior Publication Data

US 2008/0061614 A1 Mar. 13, 2008

(30) Foreign Application Priority Data

Sep. 22, 2004 (JP) ..... 2004-275877
Sep. 22, 2004 (JP) ..... 2004-275878
Sep. 22, 2004 (JP) ..... 2004-275879
Sep. 22, 2004 (JP) ..... 2004-275880

(51) Int. Cl.
*A47C 1/024* (2006.01)
*A47C 3/026* (2006.01)
*A47C 7/40* (2006.01)

(52) U.S. Cl. ..... 297/303.3; 297/300.4

(58) Field of Classification Search ..... 297/300.2, 297/300.4, 303.1, 303.2, 303.3
See application file for complete search history.

(56) References Cited

U.S. PATENT DOCUMENTS

| | | | | |
|---|---|---|---|---|
| 2,677,411 | A * | 5/1954 | Grabarczyk | 248/575 |
| 4,537,445 | A * | 8/1985 | Neuhoff | 297/300.3 |
| 4,796,950 | A * | 1/1989 | Mrotz et al. | 297/303.3 |
| 4,986,601 | A * | 1/1991 | Inoue | 297/300.4 |
| 6,386,634 | B1 * | 5/2002 | Stumpf et al. | 297/300.4 |
| 6,439,661 | B1 | 8/2002 | Brauning | 297/300.2 |

FOREIGN PATENT DOCUMENTS

| | | |
|---|---|---|
| JP | 6-327533 | 11/1994 |
| JP | 2002-142899 | 5/2002 |
| JP | 2004-49717 | 2/2004 |

OTHER PUBLICATIONS

International Search Report PCT/JP2005/017354 dated Dec. 21, 2005 (Japanese Patent Office).

* cited by examiner

*Primary Examiner*—Joseph F Edell
(74) *Attorney, Agent, or Firm*—Ostrolenk Faber LLP

(57) ABSTRACT

A back rest tilting device in a reclining chair formed of fewer parts. A force promoting unit energizes a back rest in an upright direction. A rotating force promoting unit with rubber torsion springs includes a laterally extending pivot shaft rotated integrally with the back rest and an elastic body filled between an outer tube locked to a support body coaxially with the core and the pivot shaft so that the elastic body is elastically deformed when the pivot shaft is rotated about the center axis of the outer tube to impart a returning rotating force to the pivot shaft.

8 Claims, 10 Drawing Sheets

BACKREST-TILTING DEVICE

CROSS REFERENCE TO RELATED APPLICATIONS

The present application is a 35 U.S.C. §371 national phase conversion of PCT/JP2005/017354 filed Sep. 21, 2005, which claims priority of Japanese Application No. 2004-275877 filed Sep. 22, 2004, Japanese Application No. 2004-275878 filed Sep. 22, 2004, Japanese Application No. 2004-275879 filed Sep. 22, 2004 and Japanese Application No. 2004-275880 filed Sep. 22, 2004, the disclosures of which is herein incorporated by reference. The PCT Application was published in the Japanese Language.

JP2004-49717A discloses that a rubber torsion spring is used as force-promoting unit for forcing the backrest to an upright position.

In the device, a hexagonal shaft is pivotally supported through a support supported by a leg and each end of the shaft is fixed to a pair of backrest support rods supporting the backrest. A force-promoting unit for forcing the backrest towards an upright position comprises a core having a hexagonal hole through which the shaft passes; an outer tube mounted to the support and coaxial with the core; and a plurality of force-promoting units each comprising a rubber torsion spring having an elastic material filed between the core and the outer tube, the core turning with the shaft around an axis with respect to the outer tube so that it is elastically deformed to apply return-rotation force to the shaft. Radial teeth are partially formed on a disc turning together with the backrest and core, and engage with and disengage from teeth of an engage member moved by an operating member.

U.S. Pat. No. 6,439,661B1 discloses that a rubber torsion spring is pivotally supported to a support as well as the above, comprising a hexagonal shaft turning together with a backrest support rod for supporting the backrest; a core having a hexagonal hole through which the shaft passes; an outer tube mounted to the support and coaxial with the core; and an elastic material filled between the core and the outer tube, the core turning together with the shaft around an axis with respect to the outer tube so that the core is elastically deformed to apply the shaft to return-turning force, an adjusting screw being provided at front lower part of the support being rotated to allow the outer tube to turn around the axis thereby adjusting initial promoting force of the rubber torsion spring.

However, in such a device, the core in a plurality of force-promoting units comprising a rubber torsion spring is not the same as the shaft of the backrest support rod thereby increasing the number of parts, making the structure and assembling more complicate.

Especially, in JP2004-49717A, after a plurality of force-promoting units comprising a rubber torsion spring is received in the support, the hexagonal shaft is passed through the hexagonal hole of the core of the torsion spring from the side of the support. Thereafter, the ends of the beackrest support rods supporting the backrest have to be fixed to the ends of the shaft, thereby making assembling more complicate, especially, passing the hexagonal shaft through the hexagonal hole of the core of the rubber torsion spring and requiring a lot of time.

In U.S. Pat. No. 6,439,662B1, the adjusting screw is disposed in the front lower part, so that, to adjust strength of initial promoting force for the backrest, a sitting person has to stoop or to turn around to handle the adjusting screw after one leaves a chair.

As promoting force becomes larger, turning resistance of the adjusting screw increases to make it more difficult to handle the screw.

SUMMARY OF THE INVENTION

It is an object of the present invention to provide a backrest-tilting device in a reclining chair, the device being simple in structure and being able to be easily assembled.

It is another object of the present invention to provide a backrest-tilting device in a reclining chair, enabling the backrest to be held at an optional angle, the device being simple in structure and being able to be assembled for a short time.

It is further object of the present invention to provide a backrest-tilting device in a reclining chair, initial promoting force of the backrest being easily adjusted by turning an operating handle at the lower side of a seat even when a sitting person still sits on the seat, turning resistance of an operating shaft being not able to increase even if initial promoting force of the backrest becomes larger.

It is yet another object of the present invention to provide a backrest-tilting device in a reclining chair, a pivot of a backrest support rod that supports the backrest and force-promoting unit for the backrest being easily and surely assembled to the support for a short time.

DETAILED DESCRIPTION OF PREFERRED EMBODIMENTS

Figure 1:
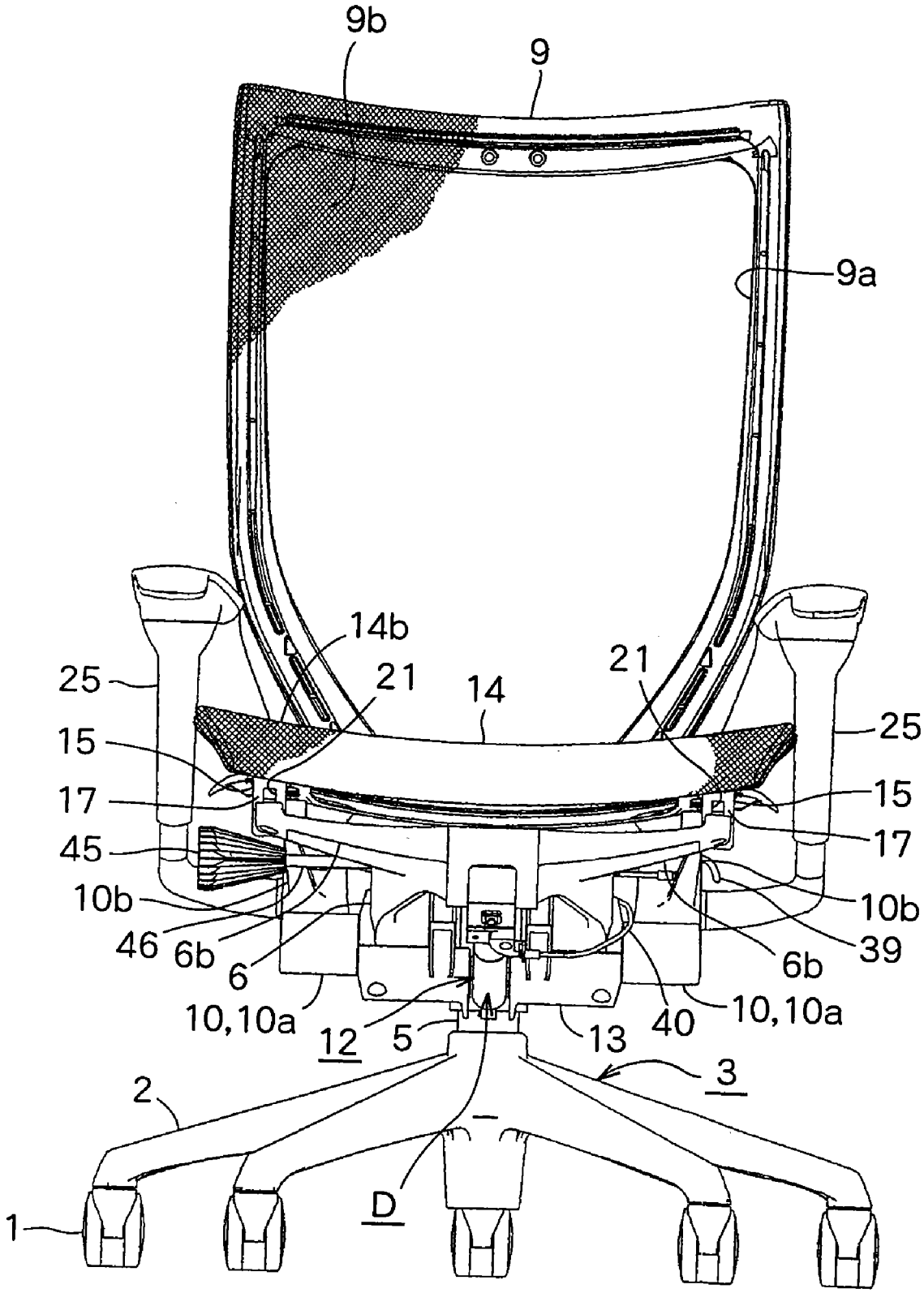
FIG. 1 is a front elevational view of a chair having an embodiment of the present invention.
Figure 2:
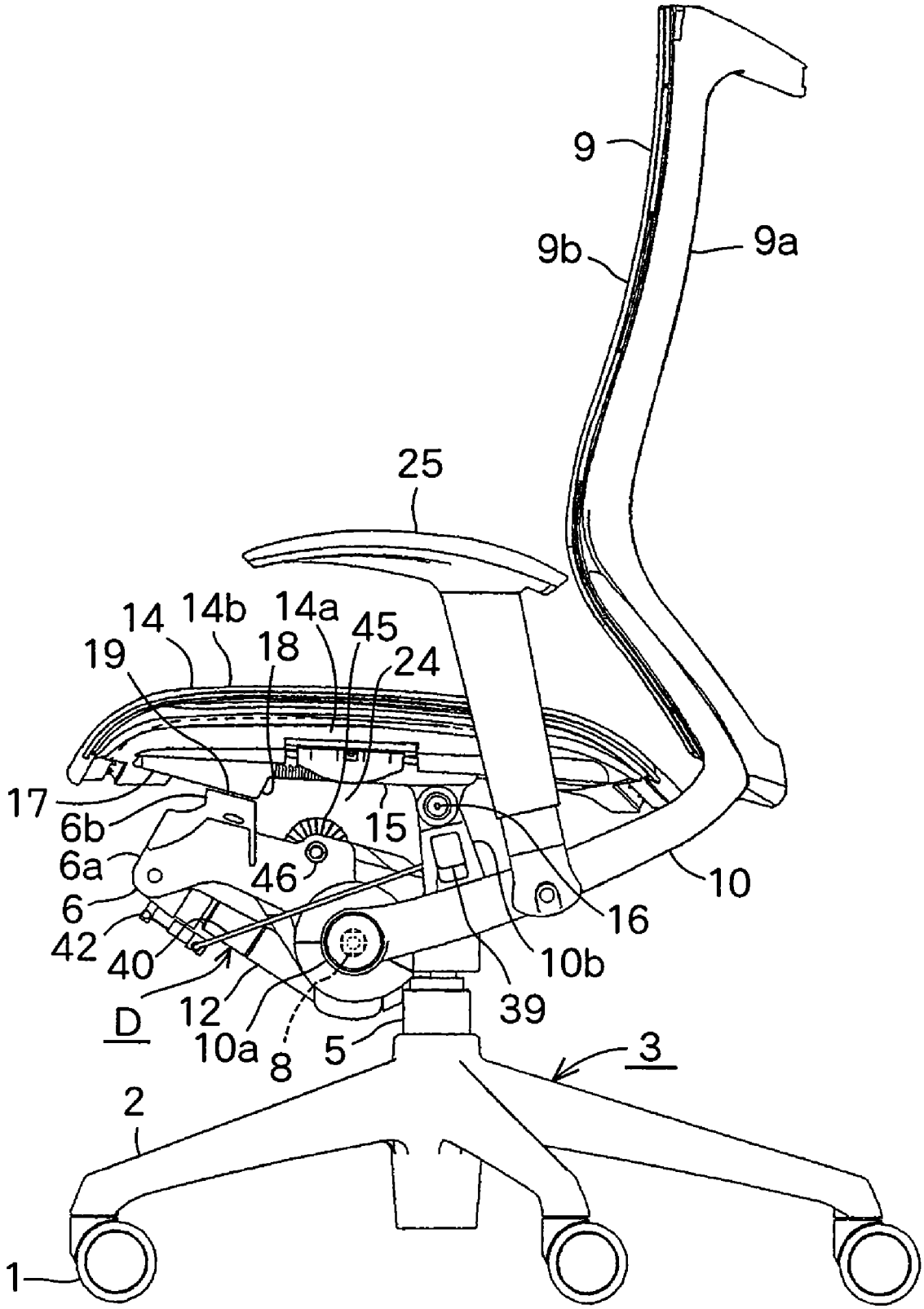
FIG. 2 is a side elevational view thereof.
Figure 3:
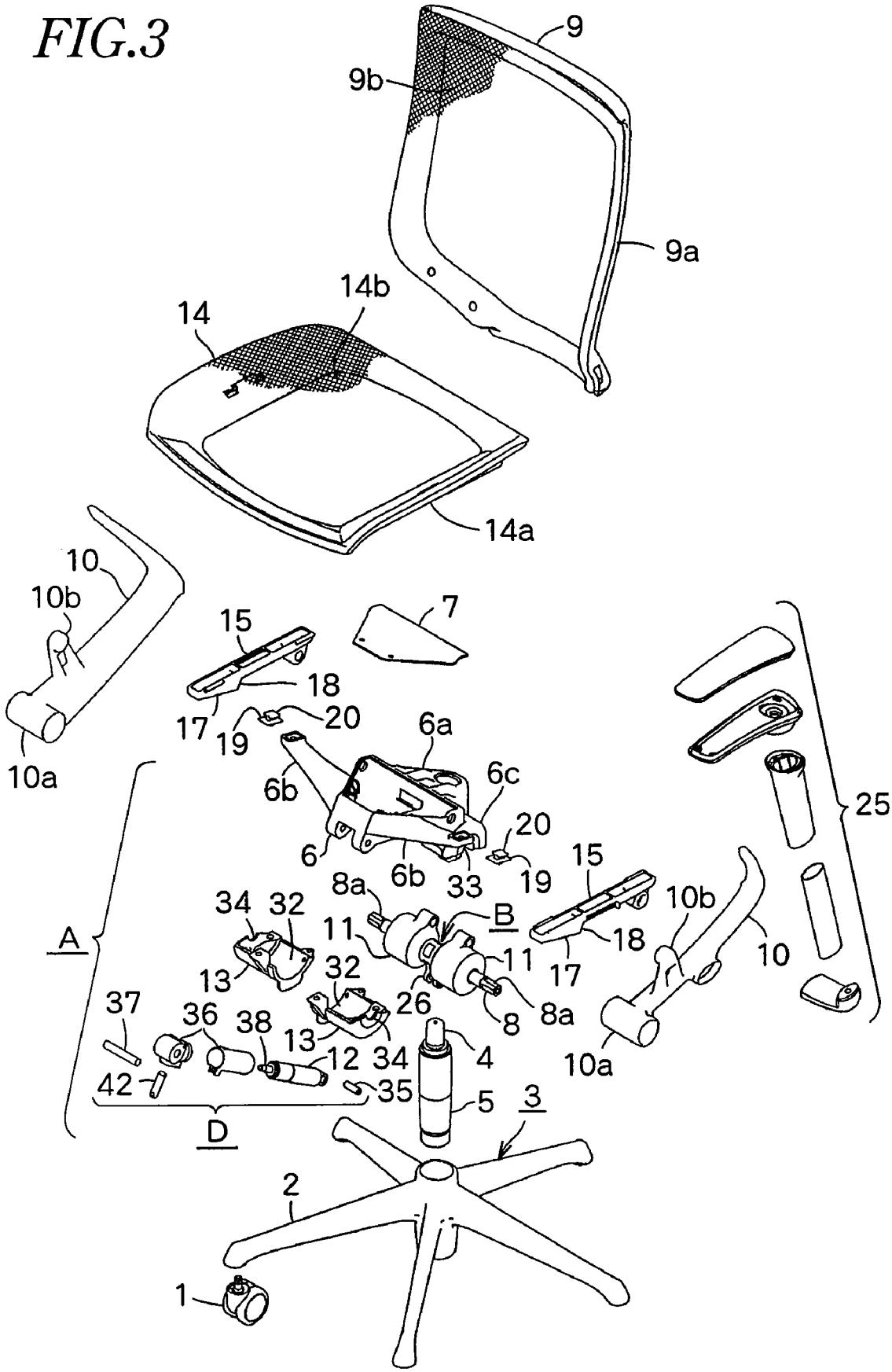
FIG. 3 is an exploded perspective view of main members.

As shown in FIGS. 1-3, a reclining chair comprises a leg 3 having five leg rods 2 radially extending and having a caster 1 at the end. At the center of the leg 3, a telescopic post 5 having a gas spring 4 is provided, and a support 6 which supports a seat 14 is fixed at the upper end of the post 5.

The support 6 comprises a hollow rhombus-shaped support body 6*a* and a front-half upper opening is covered with an upper cover 7. A pair of arms 6*b*, 6*b* are mounted on each side of the support body 6*a* so that the upper surfaces of the ends of the arms 6*b*, 6*b* are disposed at a position higher than the support body 6*a*.

A pivot 8 which has a rectangular shaft portions 8*a*, 8*a* at each end passes through the middle of the support body 6*a*. A pair of backrest support rods 10,10 support the backrest 9 and have tubular portions 10*a*, 10*a* at the front respectively. Tubular portions 10*a*, 10*a* engage with the rectangular shaft portions 8*a*, 8*a* respectively thereby rotating the pivot 8, the backrest support rods 10,10 and the backrest 9 together around the pivot 8 with respect to the support body 6.

A force-promoting unit A is provided by the pivot 8 and the backrest support rods 10,10 to force the backrest 9 to stand up.

Figure 7:
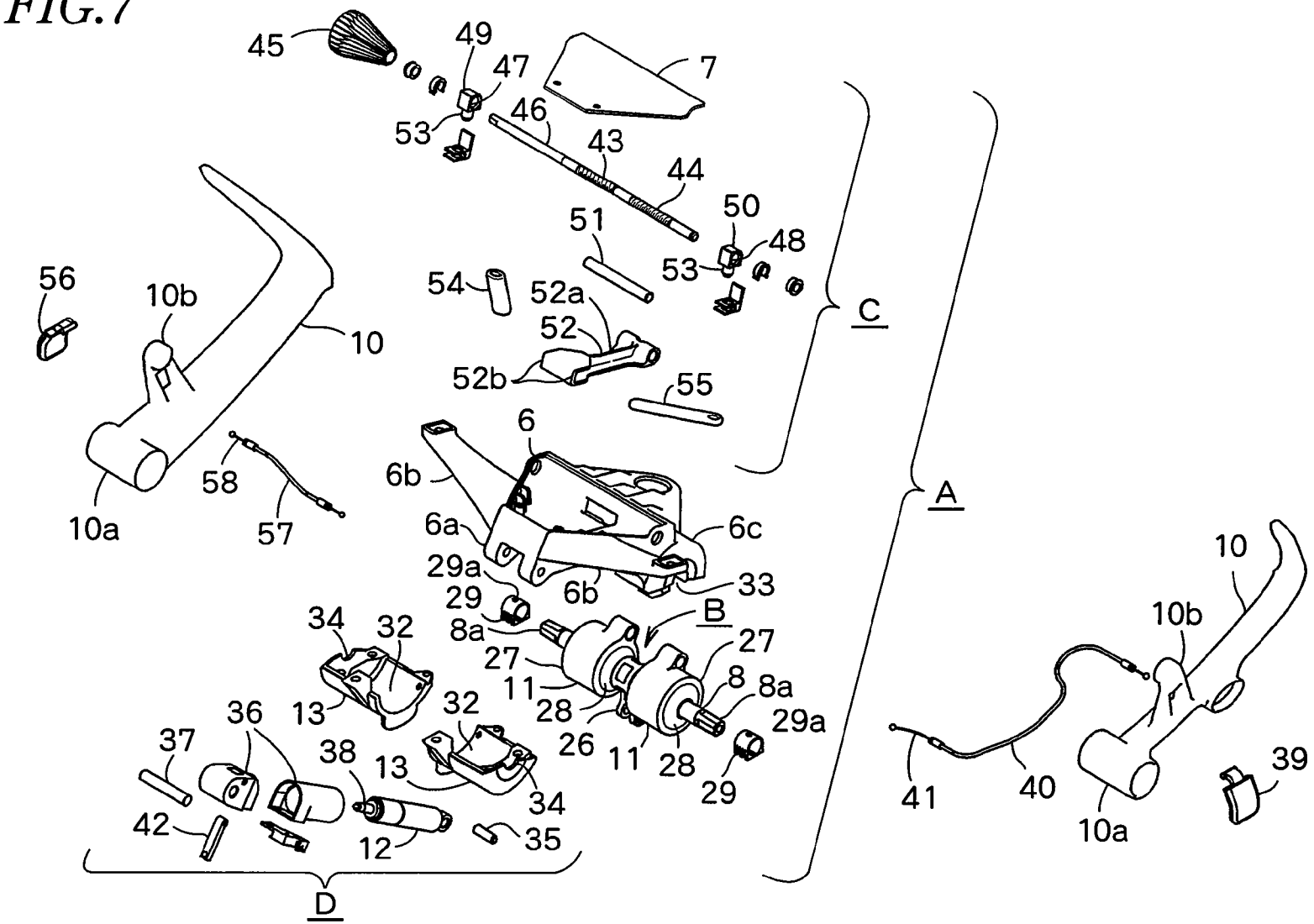
FIG. 7 is an exploded perspective view of a backrest-tilting device.
Figure 11:
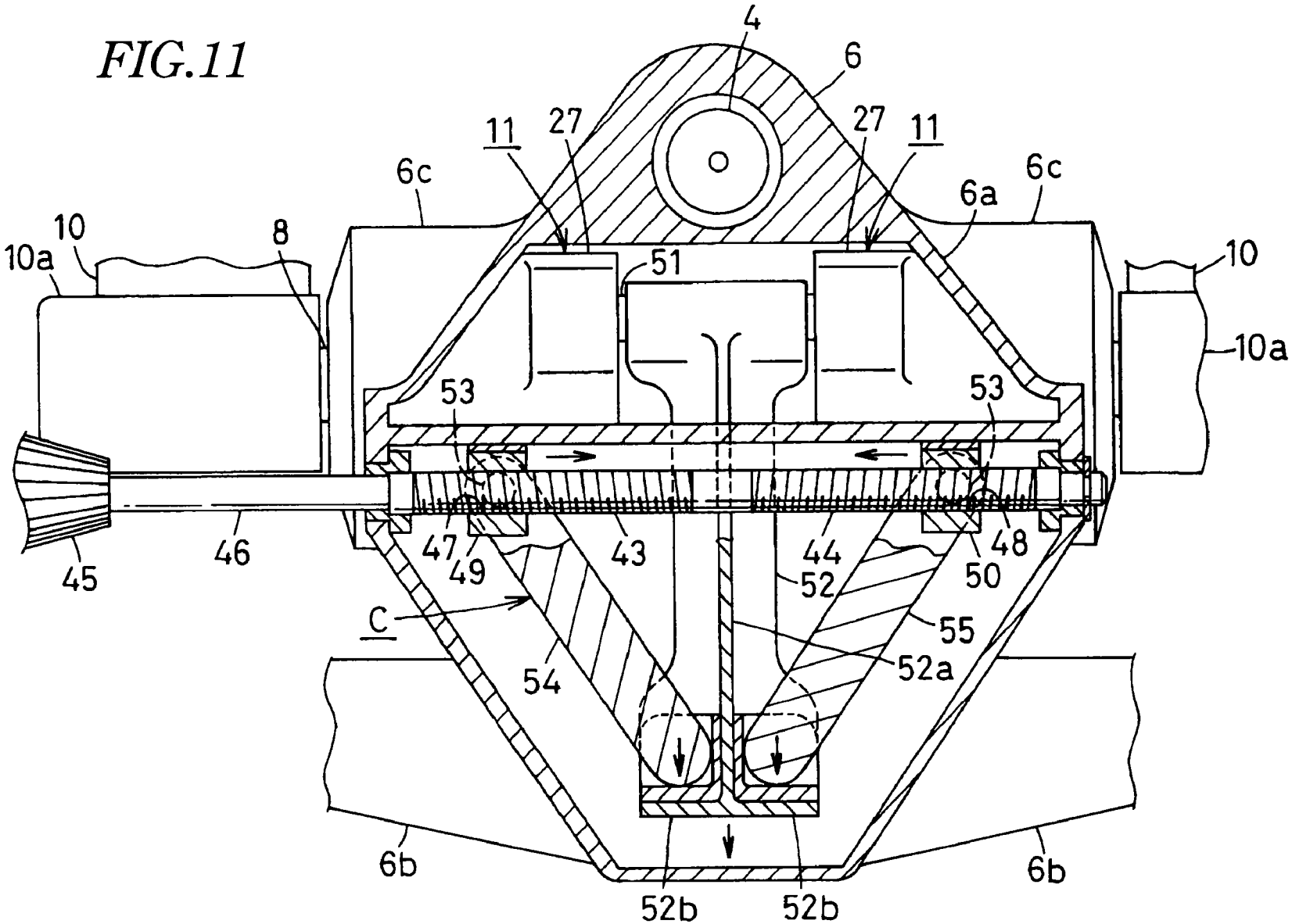
FIG. 11 is a horizontal sectional plan view taken along the line XI-XI in FIG. 8

As shown in FIG. 3, the force-promoting unit A comprises a rotation-promoting unit B which comprises two rubber torsion springs 11,11 for forcing the pivot 9 in an anticlockwise direction in FIG. 2; a promoting-force adjusting unit in FIGS. 7 and 11; and a gas-spring unit which includes a gas spring 12.

The force-promoting unit A will be described later. The reclining chair will be then described.

The lower surfaces of the rubber torsion springs 11,11 are covered with lower covers 13,13 detachably mounted to the lower surface of the support body 6*a*.

In FIGS. 3-6, short upright arms 10*b*, 10*b* are provided on the backrest support rods 10,10 behind the pivot 8. To the upper ends of the standing arms 10*b*, 10*b*, the rear ends of a pair of seat-support frames 15,15 which support the seat 14 are coupled by a shaft 16.

The front of the seat-support frame 15 has a rectangular opening, an inclined lower surface 17 and an upright wall 18 at the rear end of the inclined lower surface 17.

The inclined surface 17 is slidably disposed on an inclined surface 19 at the end of the arm 6*b* of the support 6.

Between the end of the arm 6*b* of the support 6 and the front of the seat-support frame 15, a stopper 20 prevents the inclined surface 17 from going off the inclined surface 19.

In this embodiment, the stopper 20 comprises a slit 21 in the inclined surface 17, and a headed shaft 22 which slidably fits in the slit 21 and has a head 22*a* wider than the slit 21. The slit 21 and head 22 may be provided in the inclined surfaces 19 and 17 respectively. In the figure, the headed shaft 22 is rectangular, but may be circular.

The slit 21 extends from the front end to the rear end and opens from the upright wall 18. The upright wall 18 has an opening 23 which communicates with the slit 21 to allow the larger head 22*a* of the headed shaft 22 to pass through the opening 23.

The headed shaft 22 is allowed to come from the opening 23 and to slide the inclined surface 17 on the inclined surface 19 rearwards and the rear end of the seat-support frame 15 is connected to the backrest support rod 10 to allow the seat-support frame 15 to join to the support 6 and the backrest support rod 10.

Figure 4:
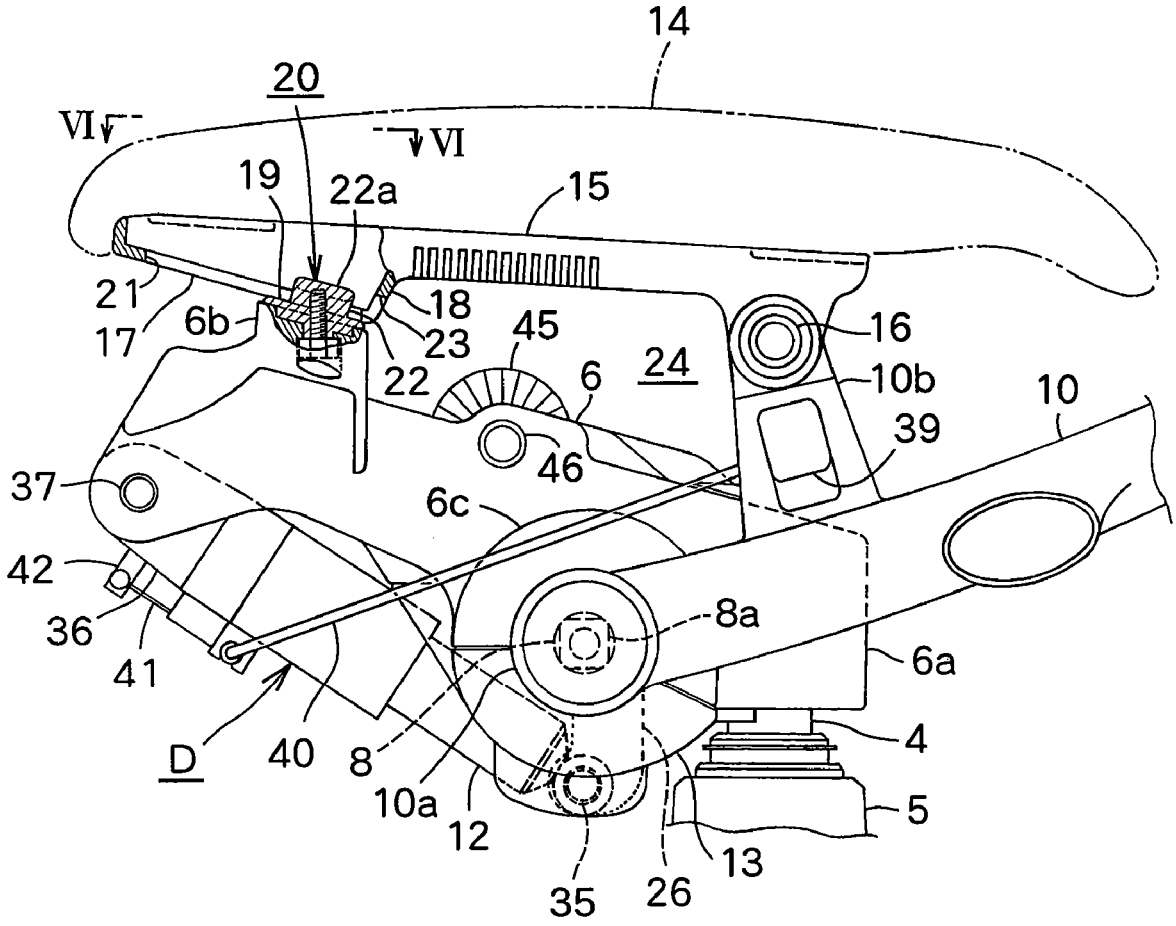
FIG. 4 is an enlarged side view of main part when the backrest is in an upright position.
Figure 5:
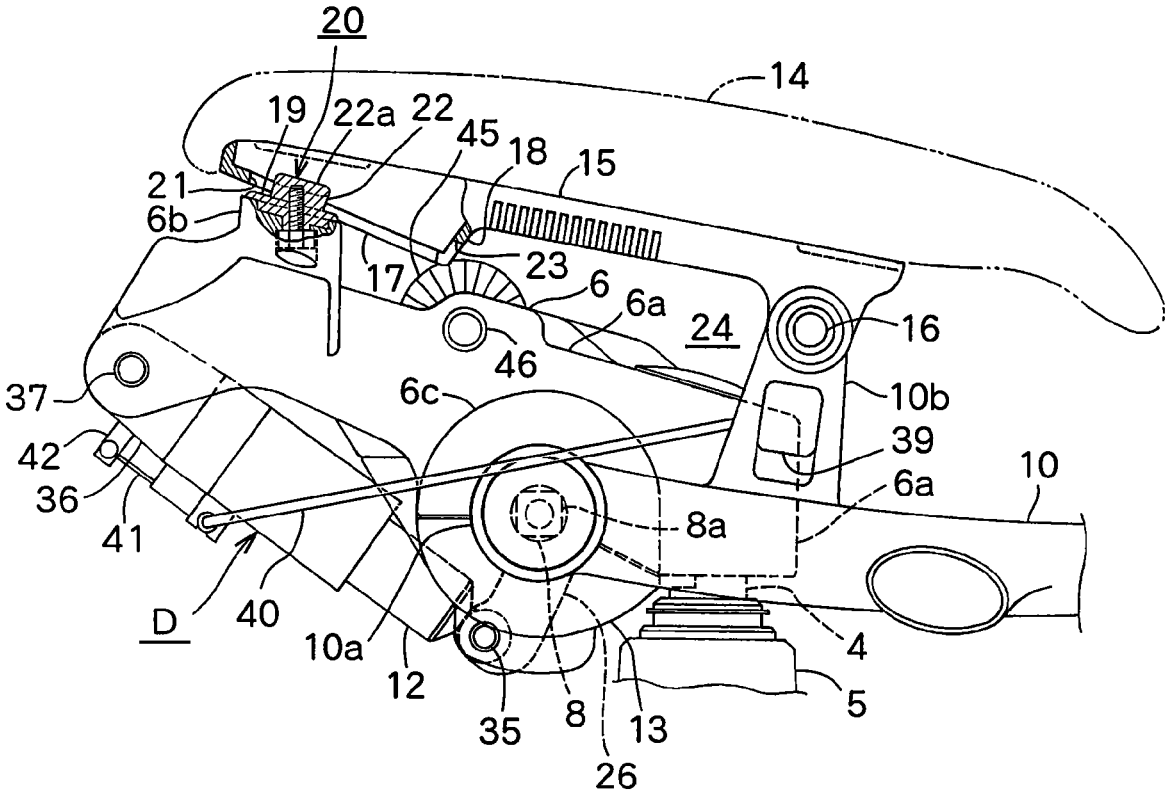
FIG. 5 is an enlarged side view thereof when the backrest is tilted rearwards.
Figure 6:
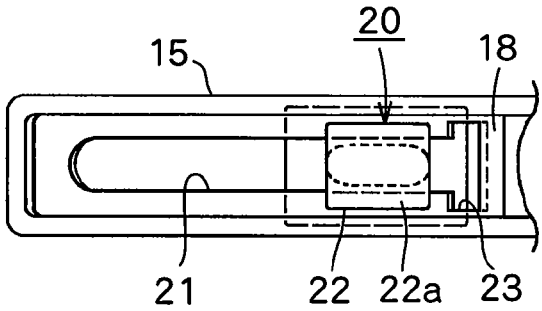
FIG. 6 is a plan view seen from the line VI-VI in FIG. 4.

After connection, with rearward inclination of the backrest from the upright position, the seat-support frame 15 and seat 14 supported by the frame 15 is moved downward and rearward from FIG. 4 to FIG. 5 while the inclined surface 17 slides on the inclined surface 19.

Then, with motion of the backrest 9 and seat 14, angles between the back and the thigh and between the thigh and the shank of a sitting person becomes wider naturally and the shank is slowly inclined backwards around the ankle of feet which contact the floor to give natural and comfortable feeling to the person.

When the backrest 9 is moved from the rearward inclined position to the upright position, the seat 14 is moved reversely to the above motion giving the person comfortability too.

If the inclined surface 17 contacts the inclined surface 19 along a straight line, the seat 14 is moved down rearward with rearward inclination of the backrest 9 to change surface contact to line contact. To enable them to achieve surface contact in a wider range, the inclined surface 17 and inclined surface 19 may be preferably gently curved.

The seat 14 comprises a rectangular seat frame 14*a* over which elastic seating material 14 such as elastic-fiber mesh, plain weave fabric or synthetic resin film is stretched. When the person sits down, the seating material 14*b* is stretched to allow the middle of the seat to curve down along the buttock of the person thereby achieving comfort seating capability.

To allow the middle of the seat to be pressed down when one sits down, four corners of the seat frame 14*a* are raised up and supported at a position higher than the support 6 by the upper surface of the arms 6*b*, 6*b* and the upright arms 10*b*, 10*b* of the backrest support rods 10,10 to produce a space 24 in which the middle of the seat 14 can be bent down, between the lower surface of the seat 14 and the upper surface of the support body 6*a*.

With respect to the backrest 9 as well as the seat 14, seating material 9*b* having similar elasticity to the seating material 14*b* is stretched over a rectangular backrest frame 9*a*.

The seat 14 is mounted over the seat-support frames 15,15 to move back and forth, which is not directly connected to this invention and omitted as to the description.

In the seat 14 which does not move back and forth, the rear part of the seat 14 may be connected to the upper parts of the upright arms 10*b*, 10*b* of the backrest support rods 10,10 and the front lower surface of the seat 14 may be mounted to the upper surfaces of the arms 6*b*, 6*b* to slide back and forth.

An armrest 24 is provided on each of the backrest support rods 10, but is not connected to this invention and omitted as to the description.

A force-promoting unit A will be described in detail with respect to FIG. 3 and FIGS. 7-11.

As shown in FIG. 7, the force-promoting unit A comprises the rotation-promoting unit B comprising two rubber torsion springs 11,11 under the support 6; the force-promoting unit C above the support 6; and the gas-spring unit D including a gas spring 12.

Figure 8:
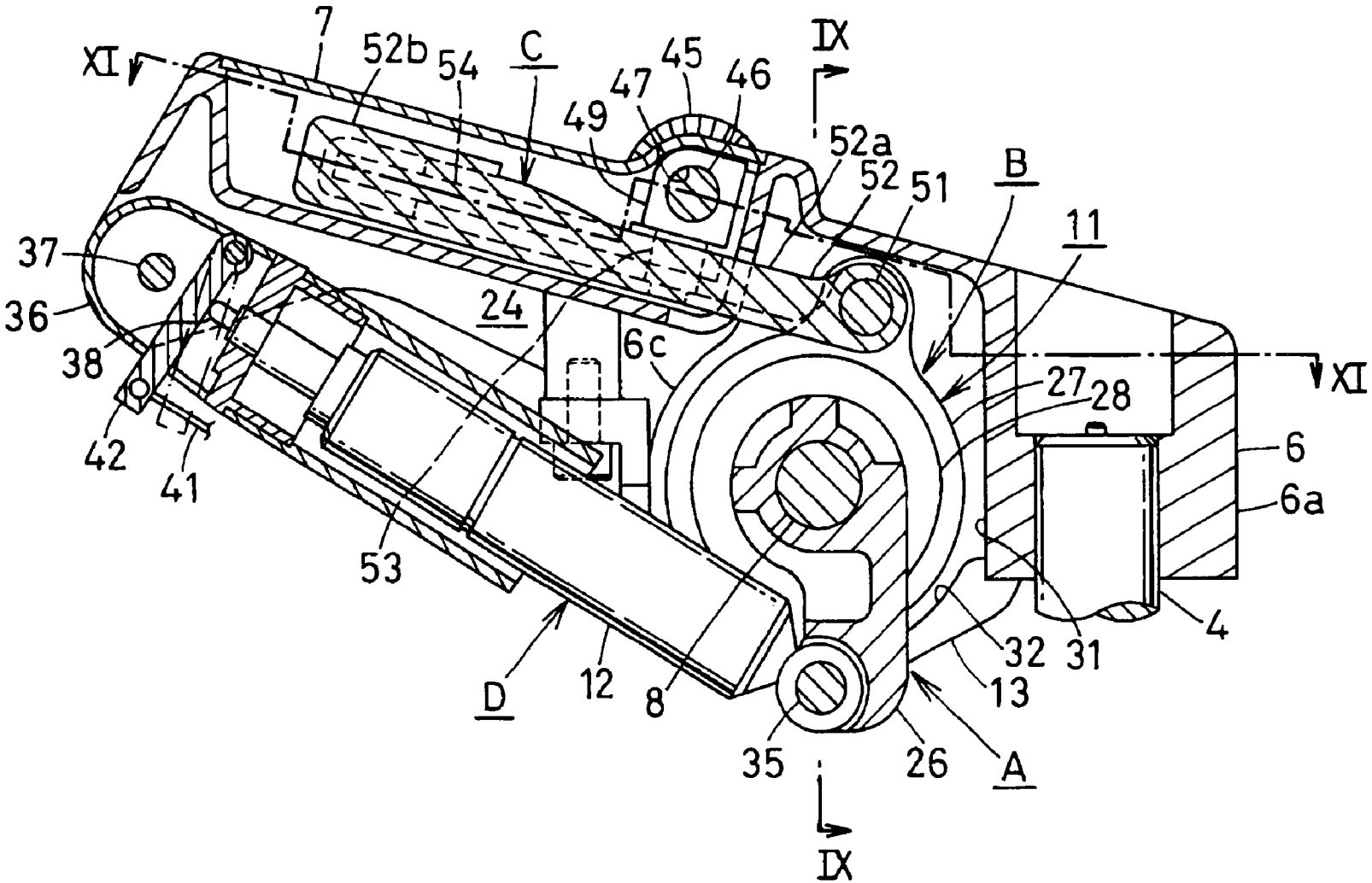
FIG. 8 is a central vertical sectional side view of a support.
Figure 9:
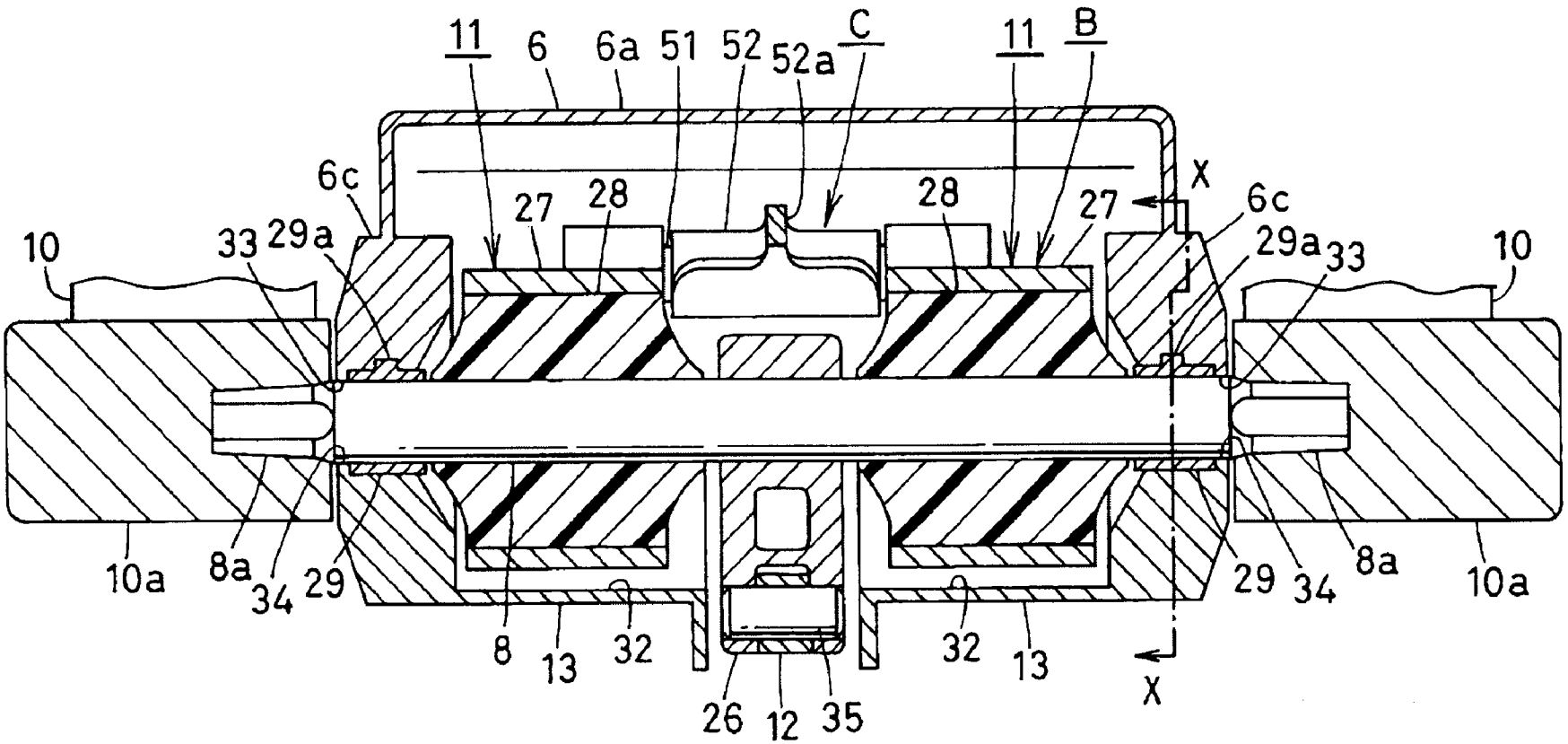
FIG. 9 is a vertical sectional front view taken along the line IX-IX in FIG. 8.

As shown in FIGS. 8 and 9, in the middle of the pivot 8, an arm 26 extends downwards perpendicular or almost perpendicular to the pivot 8. Rubber torsion springs 11, 11 are provided respectively at each side of the arm 26.

The rubber torsion spring 11 comprises a an outer tube 27 having the pivot 8 as core coaxial therewith and fixed to the support 6; and a rubber 28 filled between the outer tube 27 and the pivot 8 to allow the pivot 8 to rotate around an axis with respect to the outer tube 27 to cause the rubber 28 to deform elastically to apply return-turning force to the pivot 8.

The side ends of the pivot 8 projecting from each of the rubber torsion springs 11 engage with bearings 29,29 respectively. A positioning protrusion 29*a* is provided in the middle of the upper surface of the bearing 29.

Figure 10:
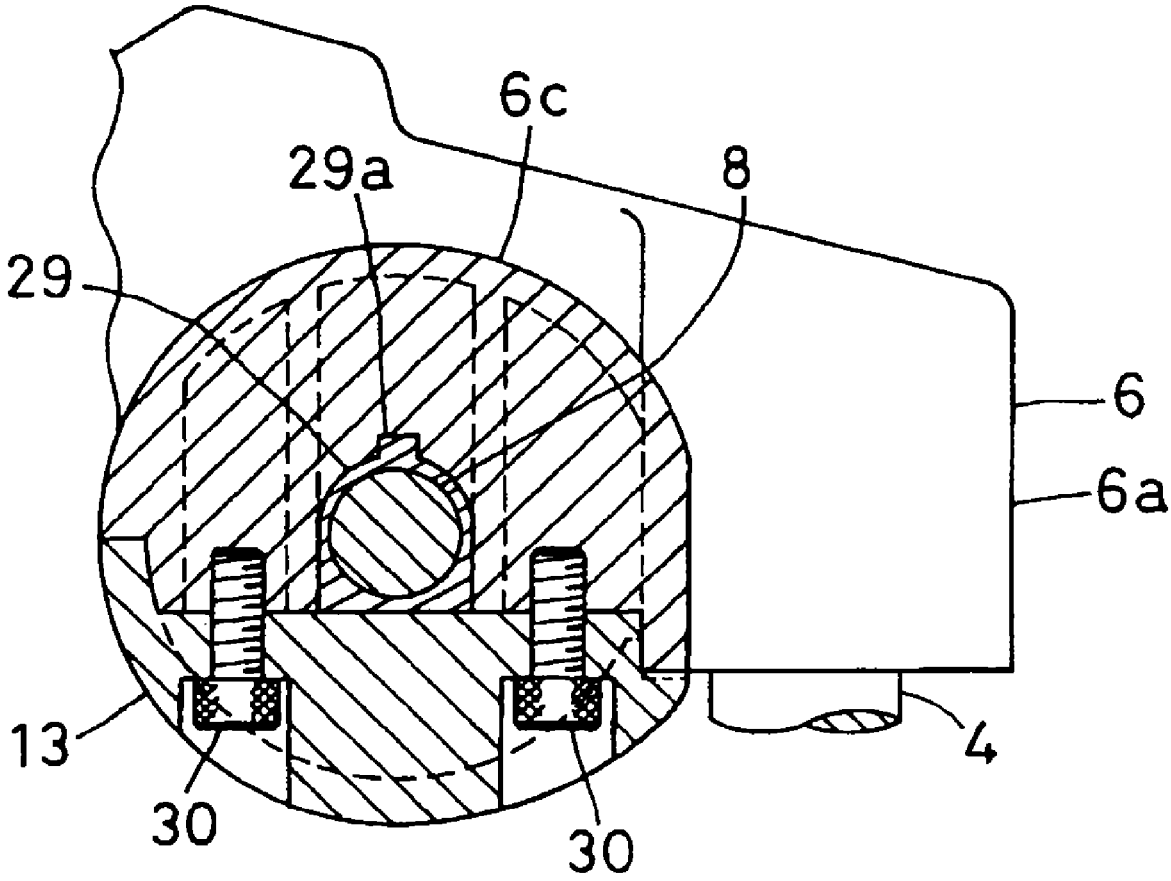
FIG. 10 is a vertical sectional side view taken along the line X-X in FIG. 9.

In FIG. 10, under the support body 6*a*, a semicylindrical portion 6*c* opens at the lower surface to which a pair of semicylindrical lower covers 13,13 are mounted with screws 30,30.

The rubber torsion springs 11,11 engage in the recesses 31,31 between the semicylindrical portion 6*c* and the lower cover 13,13. The bearings 29,29 are held between the semicylindrical portion 6*b* and the lower covers 13,13 in FIG. 10. The side ends of the pivot 8 from the bearings 13,13 passes through semicircular cut-away portions 33,34 between the semicylindrical portion 6*b* and the lower covers 13,13 in FIG. 9. Thus, the pivot 8, a pair of rubber torsion springs 11,11 and outer bearings 29,29 are stored between the semicylindrical portion 6*b* of the support 6 and lower covers 13,13.

The lower end of the gas spring 12 is joined to the lower end of the arm 26 suspending between the lower covers 12 and 13, with a shaft 35.

The front upper end of the gas spring 12 is coupled to the front middle portion of the support body 6*a* with a head cover 36 and a shaft 37.

Pressing a knob 38 at the front end of the gas spring 12 to a active position allows the gas spring 12 to extend elastically by gas pressure and force of an auxiliary spring. Returning the knob 38 to a passive position does not allow the gas spring 12 to retract.

In the head cover 36, to an operating lever 39 pivotally secured to the middle of the upright arm 10*b* of the right backrest support rod 10, a running lever 42 is connected via a wire 41 extending through the flexible outer tube 40. The operating lever 39 is pulled up to allow the running lever 42 to push the knob 38 to the active position, while a hand is released of the operating lever 39, returning force of the knob 38 to the passive position allows the running lever 42 and operating lever 39 to return the original passive position. A spring (not shown) for returning to the passive position may be provided on the operating lever 39.

The outer tube 40 is fixed at one end to the inner surface of the upright arm 10*b* of the backrest support rod 10 and at the other end to the head cover 36 to enable the wire 41 passing through the outer tube 40 to move smoothly in an axial direction.

The gas spring 12, arm 26, shafts 35,37 and head cover 36 constitute the gas spring unit D which assists force of the rotation-promoting unit B and enables the backrest 9 to be held at an optional angle by switching the knob 38 to the passive position.

In FIG. 11, the promoting-force adjusting unit C for adjusting initial promoting force of the rotation-promoting unit B comprises an operating shaft 46 pivotally secured in the middle of the support body 6*a*, having a normal thread 43, a reverse thread 44 and an operating handle 45 projecting from the support body 6*a*; a pair of movers 49,50 having female thread bores 47,48 engaging with the normal and reverse threads 43,44 respectively; a connecting rod 52 the rear end of which is coupled to a shaft 51 connecting the outer tubes 27,27 of the rubber torsion springs 11,11 to each other; and a pair of links 54,55 each of which is coupled at the rear end to each of the movers 49,50 with a vertical shaft 53 and at the front end to the front end of the connecting rod 52, rotation of the operating shaft 46 enabling the links 54,55 to open and close to move the connecting rod 52 back and forth thereby turning the outer tubes 27,27 around an axis.

In the embodiment, the front end of the connecting rod 52 is supported by the support body 6*a* to slide back and forth. A side projection 52*b* is provided at the front end of a base portion 52*a* of the connecting member 52. The front end of each of the links 54,55 contacts an inner corner between the side projection 52*b* and the base portion 52*a* to enable the front end to turn around a vertical axis.

Force of the rubber torsion springs 11,11 enables the connecting rod 52 to pull back any time, and the front ends of the links 54,55 are always positioned inner than between the rear ends, so that the front ends of the links 54,55 are not released from the inner corners between the side projection 52*b* and the base 52*a*.

However, the front ends of the links 54,55 may be pivotally secured to the front end of the connecting rod 52 with a shaft (not shown) in parallel with the shaft 53 connecting the rear ends of the links 54,55 to the movers 49,50.

Rotation of the operating shaft 46 by the operating handle 45 allows the movers 49,50 to move towards and away from each other thereby moving the connecting rod 52 back and forth to enable the outer tubes 27,27 to turn around a pivotal axis, so that initial force of the rotation-promoting unit B and whole force of the backrest 9 reduces and increases.

The operating handle 45 can be easily operated by the person who still sits, by stretching one's arm downwards of a right side.

This embodiment is set such that the movers 49,50 move towards each other to allow the links 54,55 to close thereby increasing the force of the rotation-promoting unit B. Thus, forward move of the connecting rod 52 per one rotation of the operating shaft 46 gradually decreases thereby enabling the operating handle to be operated by lighter force any time without increasing rotation resistance of the operating shaft even if initial promoting force of the backrest becomes greater.

In the middle of an upright arm 10*b* of a left-side backrest support rod 10, an operating lever 56 is pivotally mounted around a longitudinal axis as well as the operating lever 39 in the middle of the upright arm 10*b* of the right-side backrest support rod 10.

The operating lever 56 is connected to a running lever (not shown) for operating the gas spring 4 in the post 5. By turning the operating lever 56 upwards, the knob (not shown) for the gas spring 4 is pressed to the active position to allow the post 5 to extend and contract freely.

Rotation of the operating lever 56 allows a knob (not shown) of the gas spring 4 to return to a passive position thereby enabling the post 5 to be held optionally.

As described above, according to the embodiment, the pivot 8 of the backrest support rod 10 also acts as core of the rubber torsion spring 11 of the rotation-promoting unit B thereby reducing the number of parts, simplifying the structure and enabling the pivot 8 to be equipped to the support easily and readily.

Especially, it avoids necessity for inserting a shaft into a core of a rubber torsion spring of a support thereby improving efficiency of assembling.

The force-promoting unit A comprises the rotation-promoting unit B for applying turning force to the pivot 8 in a direction where the backrest 9 stands up; and the gas spring 12 which becomes stretchable by moving the knob 38 at one end to the active position and becomes rest by returning the knob 38 to the passive position, thereby forcing the backrest 9 strongly in an upright position by the rotation-promoting unit B and enabling the backrest 9 to be held optionally by the gas spring 12.

When the knob 38 of the gas spring 12 is in the active position, the rotation-promoting unit B can be additionally forced by the gas spring 12 thereby reducing the size of the rotation-promoting unit B.

The sitting person can adjust strength of initial force of the backrest 9 by turning the operating handle at the lower side of the seat while one still sits.

Furthermore, the rotation of the operating shaft 46 together with the operating handle 45 allows the movers 49,50 to move towards and away from each other and thus allows the links 54,55 to open and close thereby moving the connecting rod 52 back and forth and turning the outer tube 27 around the pivot 8 to make initial force of the rotation-promoting unit B weaker or stronger.

Specifically, the rotation of the operating shaft 46 is converted by a pantograph mechanism to back-and-forth motion of the connecting rod 52 and then to rotation of the outer tube 27.

When it is set such that the movers 49,50 moves towards each other to allow the links 54,55 to become closer to increase force of the rotation-promoting unit B, back-and-forth movement of the connecting rod 52 is gradually reduced per one rotation of the operating shaft 46. Thus, even if initial force of the backrest 9 becomes larger, the operating handle 45 can be always operated by almost constant force without increasing turning resistance of the operating shaft 46.

The rotation-promoting unit B which has the rubber torsion spring 11, the pivot 8 of the backrest support rod 10 and the bearing 29 are assembled between the support body 6*a* and the lower cover 13 which are fixed to each other thereby assuring easy mounting to the support 76 for a short time surely.

Various variations may be carried out without departing from the scope of claims as bellow:

(i) The rotation-promoting unit B may comprise a single rubber torsion spring fixed to a pivot, or more than two rubber torsion springs around a single pivot.

(ii) A torsion coil spring may be used as rotation-promoting unit B.

(iii) A cross-section of the pivot 8 may be a hexagon or other non-circular shape.

(iv) A support may comprise two separate parts comprising a support body and a cover (not shown). A space between the support body 6*a* and the cover has a rotation-promoting unit B and bearings which support a pivot. The side ends of the pivot projecting from the bearings put through openings between the support body and the cover.

What is claimed is:

1. A backrest tilting device in a reclining chair comprising a seat, a leg and a backrest, said backrest tilting device comprising:

a support supported by the leg and supporting the seat of the chair;

a pivot pivotally mounted to the support and comprising an arm extending perpendicular to said pivot;

a pair of backrest support rods having a front end fixed to the pivot and a rear end coupled to the backrest;

a rotation-promoting unit comprising a rubber torsion spring comprising the pivot as a core, an outer tube fixed to the support and elastic material positioned between the outer tube and the pivot, said pivot turning with respect to the outer tube to allow the elastic material to be elastically deformed to apply return-turning force to the pivot; and a gas spring having a front end, a rear end and a knob at the front end, the front end being coupled to the support, the rear end being coupled to an end of the arm of the pivot, the knob being configured to be moved to an active position to enable the gas spring to extend and to contract and the knob being configured to be returned to a passive position that prevents the gas spring from extending, and wherein the arm extends from the middle of the pivot, and the rotation-promoting unit is positioned at each side of the arm.

2. A backrest tilting device of claim 1 wherein the gas spring is inclined down rearward under a front part of the support, the front end of the gas spring being coupled to a middle of a front of the support.

3. A backrest tilting device of claim 1 wherein a rear part of the seat is coupled by a shaft slightly behind the pivot, a front part of the seat being supported to the front part of the support to slide back and forth so that the seat moves rearwards and downwards together with backward inclination of the backrest.

4. A backrest tilting device in a reclining chair that comprises a seat, a leg and a backrest, said backrest tilting device comprising:

a support supported by the leg and supporting the seat of the chair;

a pivot pivotally mounted to the support and an arm extending perpendicular to said pivot;

a pair of backrest support rods in which a front end is fixed to the pivot and a rear end is coupled to the backrest;

a rotation promoting unit comprising a rubber torsion spring comprising said pivot as a core, an outer tube coaxial with the pivot in the support and an elastic material between the outer tube and the pivot, said pivot turning about its axis with respect to the outer tube so that the elastic material is elastically deformed to apply return-turning force to said pivot; and a promoting-force adjusting unit comprising an operating shaft pivotally mounted to the support and comprising a normal thread, a reverse thread and an operating handle at an end of the operating shaft projecting from the support; a pair of movers having female threads engaging with said normal and reverse threads respectively; a connecting rod longitudinally extending and coupled to the outer tube of rotation-promoting unit; and a pair of links each having a first end coupled to each of the movers and a second end joined to an end of the connecting rod, said pair of links opening and closing together with rotation of the operating shaft to press said connecting rod back and forth to rotate the outer tube, thereby adjusting initial promoting force of said rotation promoting unit.

5. A backrest tilting device of claim 4 wherein the end of the connecting rod is supported on the support to enable the rod to slide back and forth, said connecting rod comprising a base portion and sideward projections, the second end of each of said pair of links contacting an inner corner between the base portion and the sideward projection.

6. A backrest tilting device of claim 4 wherein the support comprises a support body and a cover to form a space between the support body and the cover, the space having the rotation-promoting unit and bearings supporting said pivot which projects sideward, the pivot projecting from said bearing putting through gaps between the support body and the cover.

7. A backrest tilting device of claim 4 wherein side ends of the pivot projecting from the support are fixed to front ends of said pair of backrest support rods.

8. A backrest tilting device of claim 4 wherein an arm extends perpendicular to the pivot, the gas spring extending between an end of the arm and a front of the support, thereby allowing the gas spring to extend and contract by the knob.

* * * * *